US008267224B2

(12) United States Patent
Gremaud et al.

(10) Patent No.: US 8,267,224 B2
(45) Date of Patent: Sep. 18, 2012

(54) SPECIAL OPERATING MODE FOR STOPPING AN ELEVATOR CAR

(75) Inventors: Nicolas Gremaud, Wadenswil (CH); Steffen Grundmann, Bonstetten (CH)

(73) Assignee: Inventio AG, Hergiswil NW (CH)

( * ) Notice: Subject to any disclaimer, the term of this patent is extended or adjusted under 35 U.S.C. 154(b) by 425 days.

(21) Appl. No.: 12/669,139

(22) PCT Filed: Jul. 14, 2008

(86) PCT No.: PCT/EP2008/059194

§ 371 (c)(1),
(2), (4) Date: Jan. 14, 2010

(87) PCT Pub. No.: WO2009/010496

PCT Pub. Date: Jan. 22, 2009

(65) Prior Publication Data

US 2010/0187047 A1 Jul. 29, 2010

(30) Foreign Application Priority Data

Jul. 17, 2007 (EP) ..... 07112641

(51) Int. Cl.
*B66B 1/32* (2006.01)

(52) U.S. Cl. ..... 187/288; 187/393

(58) Field of Classification Search ..... 187/247, 187/277, 284, 287, 288, 289, 290, 291, 293, 187/296, 297, 391–393, 313, 314
See application file for complete search history.

(56) References Cited

U.S. PATENT DOCUMENTS

| | | | | |
|---|---|---|---|---|
| 3,961,688 | A * | 6/1976 | Maynard | 187/289 |
| 4,454,930 | A * | 6/1984 | Nomura et al. | 187/296 |
| 4,982,815 | A * | 1/1991 | Arabori et al. | 187/288 |
| 5,025,896 | A * | 6/1991 | Arabori et al. | 187/292 |
| 6,196,355 | B1 * | 3/2001 | Fargo et al. | 187/393 |
| 6,264,005 | B1 * | 7/2001 | Kang et al. | 187/290 |
| 6,269,910 | B1 * | 8/2001 | Fargo et al. | 187/287 |
| 6,516,921 | B1 * | 2/2003 | Wang | 187/263 |
| 7,434,664 | B2 * | 10/2008 | Helstrom | 187/314 |
| 7,614,481 | B2 * | 11/2009 | Okamoto et al. | 187/305 |
| 7,686,139 | B2 * | 3/2010 | Kondo et al. | 187/391 |
| 2010/0101897 | A1 * | 4/2010 | Hashimoto et al. | 187/254 |
| 2010/0170751 | A1 * | 7/2010 | Hashimoto et al. | 187/288 |

FOREIGN PATENT DOCUMENTS

| | | |
|---|---|---|
| GB | 1 469 576 A | 4/1977 |
| JP | 2004-224492 A | 8/2004 |

* cited by examiner

*Primary Examiner* — Anthony Salata
(74) *Attorney, Agent, or Firm* — Fraser Clemens; Martin & Miller LLC; William J. Clemens

(57) ABSTRACT

The elevator car is arranged movably along guideways and in the special operating mode is decelerated to a standstill and kept at a standstill by a braking device, by a braking force brought about by the braking device together with a brakeway. A required deceleration to bring the elevator car to a standstill within a next-possible exit zone in the special operating mode is calculated, furthermore a stopping of the elevator car is detected if a sudden change in the braking force or the acceleration is established and the braking force of the braking device is set to a holding force when the stopping is established. The special operating mode results in the elevator car coming to a stop directly in the region of an exit zone in a special operating mode and passengers in the car being able to leave the elevator car independently.

10 Claims, 3 Drawing Sheets

Fig. 1
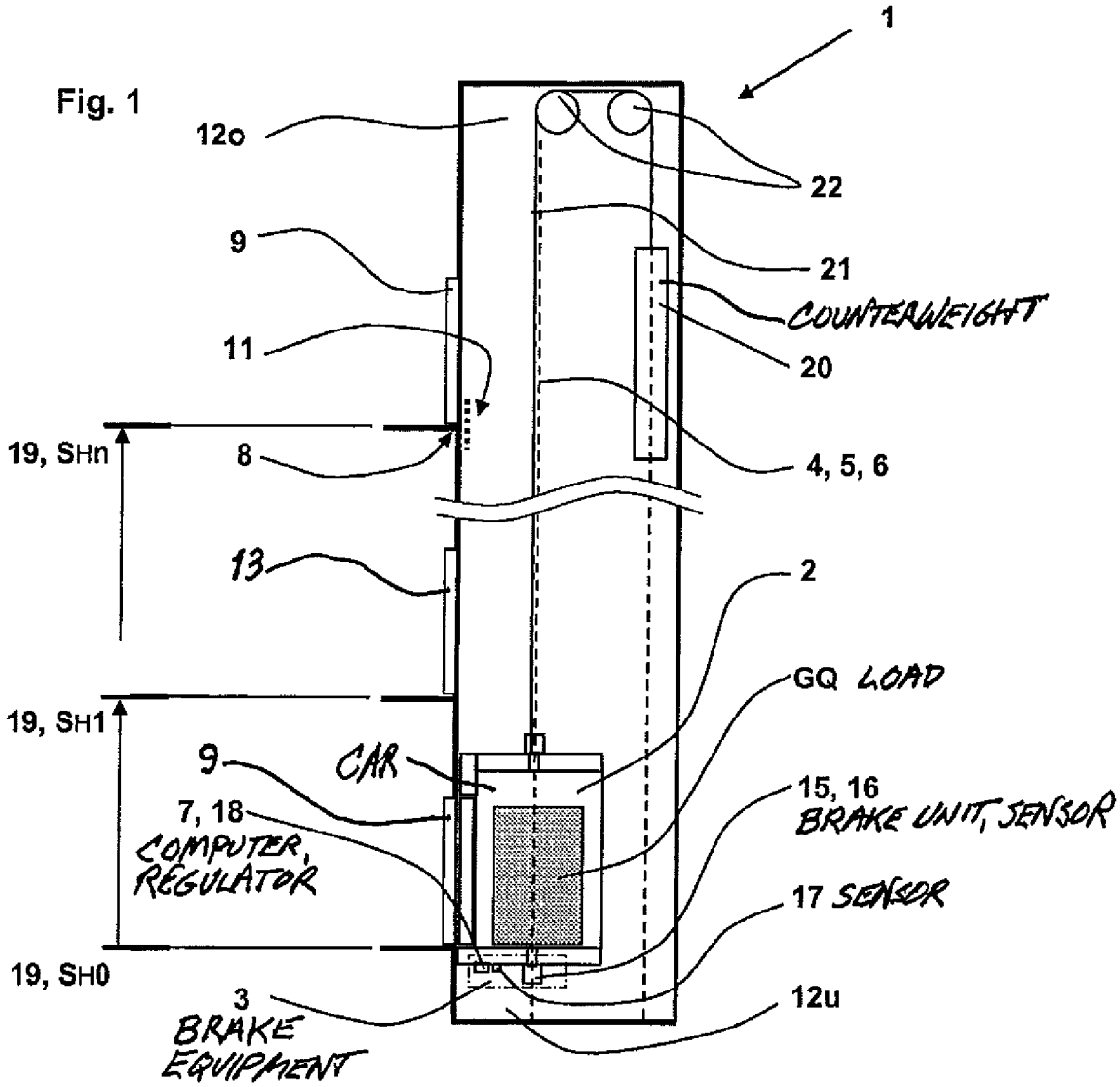
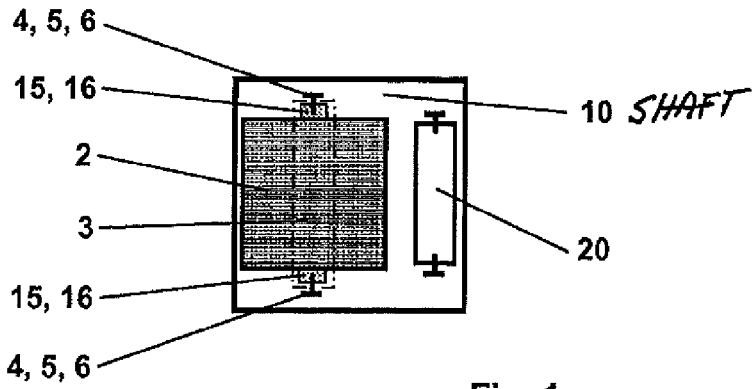
Fig. 1a

SPECIAL OPERATING MODE FOR STOPPING AN ELEVATOR CAR

FIELD OF THE INVENTION

The invention relates to an elevator system with an elevator car, brake equipment for stopping an elevator car in a special operating mode and a method of stopping an elevator car in a special operating mode.

BACKGROUND OF THE INVENTION

The elevator system is installed in a shaft. It essentially consists of an elevator car which is connected by way of suspension means with a counterweight. The car is moved along a substantially vertical guide track by means of a drive which selectably acts on the suspension means, directly on the car or directly on the counterweight. In a normal operating mode the elevator car is accelerated by the drive in correspondence with a normal travel plot, kept in constant motion and again decelerated. A holding brake controlled together with the drive fixes the elevator car at standstill. An elevator regulating algorithm by means of which a travel plot can be regulated in the normal operating mode of an elevator car to be as comfortable as possible is shown in U.S. Pat. No. 4,130,184. In this connection, in particular, travel plots are demonstrated which take into consideration the fact that a maximum travel speed cannot be achieved with short travel distances or floor spacings. According to U.S. Pat. No. 4,130,184, for short floor spacings there is direct transition from a regulated acceleration phase to a regulated deceleration phase.

If the elevator car departs from the normal travel plot usual in normal operation this is detected by a safety monitoring system. The moved elevator car is then, in a special operating mode, decelerated to standstill by brake equipment by means of a braking force, which is produced by the brake equipment together with a brake track, and subsequently held at standstill. A special operating mode arises when an intended travel sequence has to be interrupted due to a fault and accordingly it is not possible to travel to a planned destination stopping point. This includes, for example, departure of an effective travel movement from the normal travel plot, an interruption of drive energy, a failure of operating-mode brake systems or also a failure of the suspension means.

EP 1792864 shows brake equipment of that kind in the form of a safety brake. In this regard the safety brake is actuated, which rapidly and safely stops the elevator car, if fault behavior is detected. The braking force is produced in these items of braking equipment in that a brake lining is pressed by a force against the brake track. This pressing force is termed normal force and the braking force results from this normal force and a coefficient of friction specific to a brake pairing. The brake pair is defined by the brake lining and the brake track.

Another elevator system of that kind or brake equipment is known from EP 0648703. In this connection the elevator car is, in a special operating mode, decelerated and held at standstill by means of regulable brake equipment independent of the drive.

A disagreeable aspect of these elevator systems is that after response of this brake equipment in the special operating mode the elevator car comes to a stop at random. A long waiting time usually follows until service personnel are on site in order to free any trapped persons. Moreover, there is no solution as to how the state of a stationary car can be recognized in order to securely hold it after standstill has taken place. It would be obvious for this purpose to make use of a signal of a speed sensor from which naturally a standstill state can be recognised.

SUMMARY OF THE INVENTION

Different demands on an elevator system or the corresponding brake equipment thus result. A simple release of persons who, in the event of a possible fault condition, are trapped in an elevator car shall be made possible. In the special operating mode, a safe holding of the elevator car shall be ensured after braking has taken place. Moreover, a simple and clear functional structure shall be present. In accordance with the invention solutions fulfilling at least parts of these objects shall be demonstrated.

The invention fulfils this object in that a solution is demonstrated which enables simple release of persons who in the special operating mode are located in the elevator car. Moreover, a solution is demonstrated which guarantees safe holding of the elevator car after braking has taken place. The two solutions complement one another in their functions.

According to the invention the brake equipment calculates a required deceleration in order to bring the elevator car to standstill within an exit zone in the special operating mode. This is advantageous, since simple release of persons located in the elevator car in the special operating mode is thus made possible. A lengthy stay of trapped persons in a stationary car is thereby eliminated.

Alternatively or additionally the brake equipment further recognizes that standstill of the elevator car has taken place when an abrupt change in the braking force and/or in a measured actual acceleration is detected. The brake equipment sets a braking force default or a normal force in correspondence with a holding force when it is detected that standstill has taken place. This is advantageous, since the elevator car is thereby securely fixed after braking has taken place. The elevator car can thus be freed for disembarking. Slipping of the elevator car is prevented while persons leave the elevator car or when, for example, service personnel enter the car. In this connection it is to be taken into account that a braking force, in order to decelerate an elevator car in the special operating mode or in a fault case, can in fact be very small if, for example, the elevator car is loaded in such a manner that it is in an equilibrium state with respect to the counterweight. The holding force is the force which is needed in order to securely fix an elevator car with consideration of possible loading or handling situations. The braking force is the force which is needed or is present in order securely decelerate an elevator car disposed in motion.

In addition, the brake equipment advantageously includes a braking force sensor which measures the braking force. The braking force can thus be simply, quickly and reliably detected. Moreover, the braking force sensor is usually a component of the brake equipment itself. Thus, a simple and clear functional structure and, in addition, an economic construction equally result.

An abrupt change in the braking force can be determined in particularly simple manner if a change of the effective direction of the braking force is detected. A change of that kind of the effective direction of the braking force results from a change of the movement direction of the elevator car. An abrupt change in the braking force can also be detected when a deceleration component of the braking force ceases at the moment at which the elevator car comes to a stop. The cessation of the deceleration or acceleration component can be established in simple manner by measurement of the actual acceleration or by measurement of the braking force. These are particularly simple and reliable variants for secure detection of standstill. The form of variant used in the individual case obviously results from a current operating situation and special operating or fault situation. If, for example, a lightly loaded elevator car moves downwards and this car has to be stopped due to an unexpected event, then only a very small braking force is necessary in order to decelerate the elevator car, since it is already decelerated by virtue of the excess weight of the counterweight. If the car now comes to a stop, the car, due to the still existing excess weight of the counterweight, would like to move upwardly. This can now be ascertained, since the effective direction of the braking force changes and the braking force default can be increased in such a manner that a high and safe level of holding force results. The car can thus be smoothly decelerated and yet securely held.

On the other hand, if, for example, the lightly laden elevator car moves upwards and this car has to be stopped due to an unexpected event or a fault, then the excess weight of the counterweight imposes further acceleration on the car. A braking force which on the one hand provides compensation for a static excess weight of the counterweight and exerts a dynamic braking component is thus necessary. If the car now comes to a stop the dynamic braking component is eliminated, since only the excess weight of the counterweight still has to be held. This can now be ascertained in similarly simple manner, since the braking force or the acceleration abruptly changes. In this case the braking force default with normal force has to be increased to such an extent that a high and secure level of holding force results. The car can thus again be smoothly decelerated and subsequently securely held.

The high level of holding force ensures that the car cannot suddenly slip during servicing activities which now follow. In this connection it is obvious that different possibilities for setting the holding force required at the stop exist depending on the form of construction of the brake equipment. For example, brake equipment can be used in which a normal force is regulated or controlled in order to achieve a specific braking or holding force. In this regard the braking force default becomes a normal force default according to which the brake equipment sets an effective normal force. A correspondingly high normal force default is made in order to achieve a necessary high level of holding force.

In another example, a direct braking force regulation or a deceleration regulation is used. In this connection, in order to achieve a necessary high level of holding force a correspondingly high braking force default or a correspondingly high deceleration default is made. The brake equipment due to the braking force default will necessarily produce a maximum application force or normal force since indeed at the stop with non-moving elevator car merely a braking force corresponding with the holding force can be measured and—since this value is lower than the braking force default at the stop—the brake equipment consequently seeks to increase this value.

However, it is also apparent from that that obviously with use of a normal force regulation the brake equipment can be conserved, since only a normal force default required for holding can be made. The term "normal force" is used in this connection in the following, wherein an application force arising from a braking force regulation or deceleration regulation is equally also included.

Advantageously, the brake equipment sets the normal force after a maximum expected braking time or, on detection of a brake fault, to a value corresponding with the holding force. This gives double safety, since in the case of a disturbance of the brake system a secure holding force is set after a time when the car should have already been securely stopped. System safety is increased.

As a rule the elevator car is arranged in an elevator shaft having shaft doors and/or emergency doors through which the elevator car can be entered. The exit zone is determined by an approach region of the elevator car with respect to the shaft door or emergency door. This is advantageous, since this construction allows departure from the car at a normal stopping point.

A normal stopping point is a stopping point which is also moved to in the normal operating mode. The exit zone is in that case, for example, the region in which a car door is disposed in engagement with a shaft door and thus can be opened without risk by hand or possibly in electrically controlled manner. It is obvious that in special operating mode an exact alignment of car door with shaft door does not necessarily have to take place. Formation of a step of up to 0.25 meters can in fact be accepted in special operating mode. Equally, in this event a warning or display making reference to a possible step can be provided. Persons are thus warned. A greater distance of up to 0.5 meters is equally possible in a boundary case. In this case, however, the intervention of a trained person who can open the shaft door and car door by hand is already necessary.

In specific buildings it is also possible to define emergency exit zones. This is useful if greater travel distances without normal stopping points are present, such as occurs in, for example, elevator systems with so-called express zones. These emergency exit zones are provided with the emergency doors.

Advantageously, the brake equipment is constructed in such a manner that during the movement of the elevator car in the normal operating mode it calculates a plurality of times a hypothetically required deceleration which would be necessary in order to bring the elevator car to standstill within the exit zone in the special operating mode. This is particularly advantageous, since the brake equipment is thereby in a position of rapidly reacting. Moreover, through this repeated calculating process of the hypothetically required deceleration a check is made possible, since the hypothetically required deceleration can be subjected to a plausibility check. Advantageously, the calculation of the hypothetically required deceleration takes place at short intervals in time or constantly. The time interval is selected in such a manner that a sufficiently precise approach to the exit zone is possible. The time interval can be selected in dependence on a travel speed of the elevator car. Usually a time interval of less than 1 second is required.

As a rule there is movement to a next possible exit zone. This is that zone which can be reached with a comfortable rate of deceleration. A deceleration of, for example, less than 4 $m/s^2$ can be termed comfortable rate of deceleration. Depending on an operating situation or the kind of special operating mode use can obviously also be made of higher deceleration values. This is particularly the case when a possible collision with to an obstacle such as, for example, another car, a shaft end or a shaft door open in the immediate vicinity is detected.

Advantageously, the hypothetically required deceleration is defined and employed directly, for realization of the braking, as required deceleration in a case of occurrence of an unexpected event, wherein on occasion the brake equipment determines, with use of this required deceleration, further brake regulating variables such as braking force or normal force. This solution gives a clear functional structure. Braking can take place autonomously from the instant of occurrence of the unexpected event, since the brake equipment merely has to maintain the predetermined deceleration value.

Advantageously, the brake equipment is in a position of determining a brake application point delayed in time or the brake equipment determines the deceleration in the form of a desired reference acceleration plot when this is required for reaching a nearest exit zone. A desired form of the reference acceleration plot is, for example, a plot which initially provides a high rate of deceleration and after a correspondingly strong deceleration phase slips down with low rate of deceleration to the exit zone. Selectably, a contrary form of the reference acceleration plot can be determined according to which initially even an acceleration is permitted in order to thereafter go over to a deceleration phase and slip down to the exit zone.

These possibilities are advantageous, since depending on a distance to the next possible exit zone the time until reaching the exit zone can be optimized according to need.

Advantageously, for calculation of the required decelerations use is made of a brake computer which is at least functionally separate from other control functions.

Advantageously, the brake equipment includes an acceleration sensor and an acceleration regulator, which during braking make use of the required deceleration, which is predetermined by the brake computer, as target value and the normal force as correcting variable, wherein the brake equipment advantageously further includes at least two brake units which each act on a respective brake track. In that case the brake equipment determines brake regulating variables for each of the individual brake units. This is advantageous, since compensation can then be made for faults of a brake unit by the remaining brake units.

The brake equipment is advantageously an electromechanical or a hydraulic or an entirely mechanical friction brake device. Use can also be made of a combination of different items of brake equipment. This increases the functional reliability of the overall system, since different kinds are, with advantage, usually complementary in fault situations.

The brake track is advantageously integrally joined with the guide track. This gives an economic overall solution.

In a development, the required deceleration and/or the brake application point delayed in time is or are determined with consideration of a speed, a current position of the elevator car with respect to a shaft end, the shaft door, the emergency door or a further elevator car, an operating mode of the elevator system, or a state of the brake equipment. Stopping of the elevator car, which is as comfortable as possible, but nevertheless safe, can thereby be achieved in the special operating mode on every occasion.

DESCRIPTION OF THE DRAWINGS

The invention is explained in more detail in the following by way of an exemplifying embodiment in conjunction with the figures, in which:

FIG. 1 shows a schematic view of an elevator system;

FIG. 1*a* shows a plan view of the elevator system of FIG. 1;

DESCRIPTION OF THE PREFERRED EMBODIMENT

Figure 2:
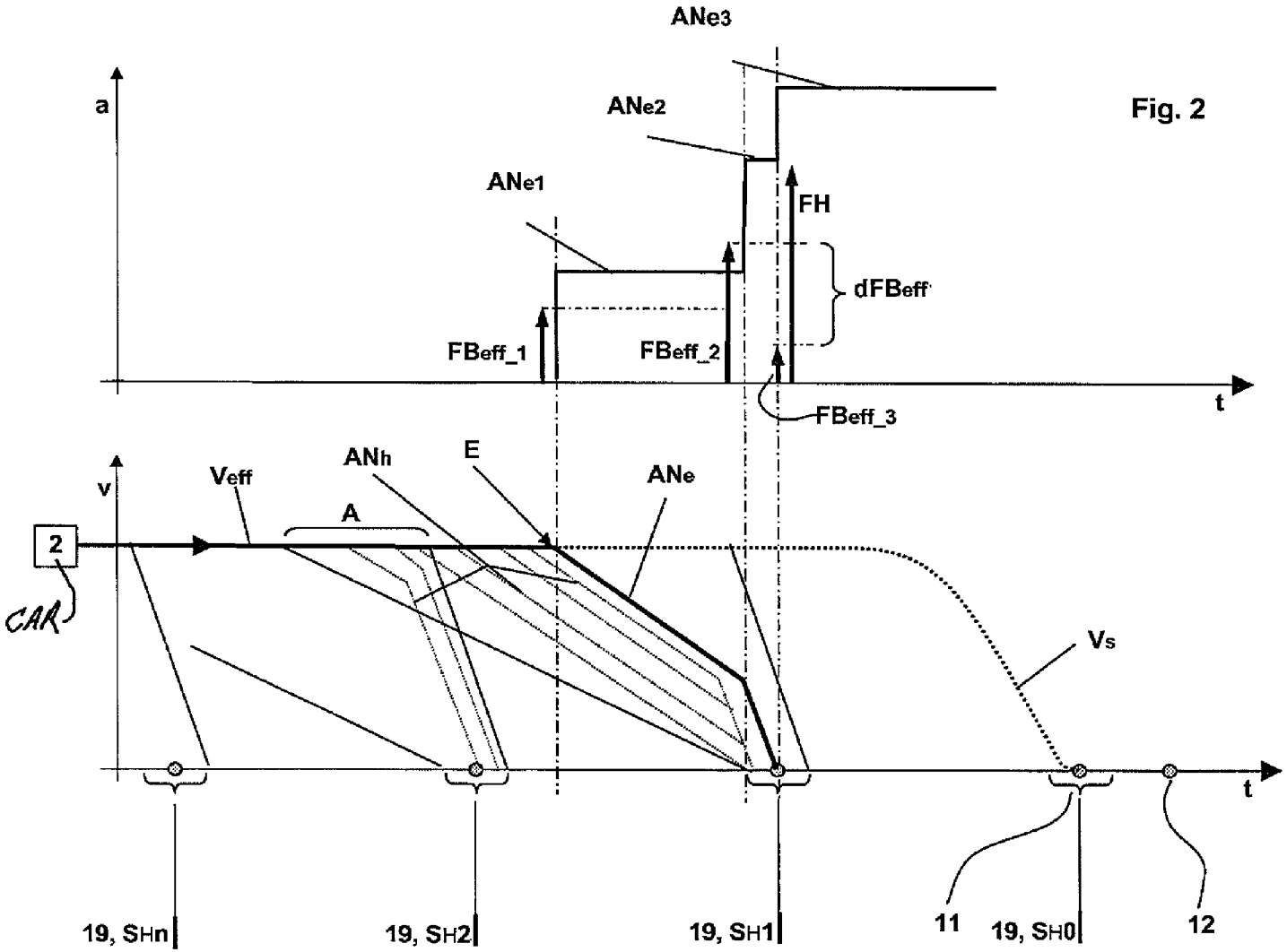
FIG. 2 shows a travel diagram.

FIG. 1 shows, together with the associated plan view according to FIG. 1*a*, an example of an elevator system 1. The elevator system 1 comprises an elevator car 2 which is connected by way of support means 21, such as a suspension rope or belt, with a counterweight 20. The elevator car 2 is driven by a drive 22 by way of suspension means 21. The elevator car 2 is guided in substantially vertical direction in an elevator shaft 10 by guide tracks 4. The elevator car 2 and the counterweight 20 move in opposite sense in the elevator shaft 10. The elevator car 2 serves for transport of a load GQ to be conveyed. The elevator shaft has shaft doors 9 which are arranged at floors and which according to need make possible or block access to the elevator car 2. In operation, the elevator car is moved along the shaft doors 9. The elevator car is in this regard stopped in an exit region 8 of the associated shaft door 9 for the purpose of loading or unloading. The locations of the individual shaft doors 9 or of the associated exit regions 8 are in this connection known in the form of absolute positions 19. In FIG. 1 the absolute positions 19 are provided with the values SH0 to SHn. Instead of shaft doors 9, also merely an emergency door 13 can be present at specific floors. This is frequently used when an elevator car 2 does not, in the normal case, have to stop over greater travel distances or express zones. In the usual case or normal case movement of the elevator car is carried out by way of an elevator control (not illustrated), which appropriately controls the drive 22. The elevator shaft 10 or a travel path of the elevator car is bounded by an upper shaft end 12*o* and a lower shaft end 12*u*.

The illustrated elevator car 2 is provided with brake equipment 3, which is attached to the elevator car 2 and which if required can brake the elevator car 2 from a travel state to standstill and/or keep it at standstill. For this purpose the brake equipment 3 engages in a brake track 5. In the illustrated example the brake track 5 and the guide track 4 are formed by a guide rail 6, which in known mode and manner is constructed as a T-shaped guide rail.

In the illustrated example the brake equipment 3 includes two brake units 15 which can each engage a respective guide rail 6, the guide rails being arranged on either side of the car 2. The brake equipment 3 further includes a brake computer 7 and an acceleration regulator 18 and associated sensors. One sensor is, for example, a braking force sensor 16, which measures a braking force produced by the brake unit 15, or an acceleration sensor 17, which ascertains a current acceleration state of the elevator car 2.

In a special operating situation or an emergency situation, for example when—in an extreme circumstance—the illustrated suspension means 21 fail, the brake equipment 3 or the brake units 15 is or are controlled in drive in such a manner that the elevator car 3 automatically comes to a stop within a next possible exit zone 8. The stopping accuracy in this connection does not have to be absolutely precise. It is sufficient if the elevator car comes to a stop in an approach region 11. The approach region 11 is advantageously dimensioned in such a manner that the shaft door 9 or the emergency door 13 can be opened without special precautionary measures. According to experience this approach region 11 embraces approximately a region which can lie up to 250 millimeters adjacent to the exact exit region 8. In addition, the brake equipment 3 automatically establishes when the elevator car 2 reaches standstill and at this instant it increases a normal force of the brake unit in such a manner that the elevator car 2 is securely held.

Figure 3:
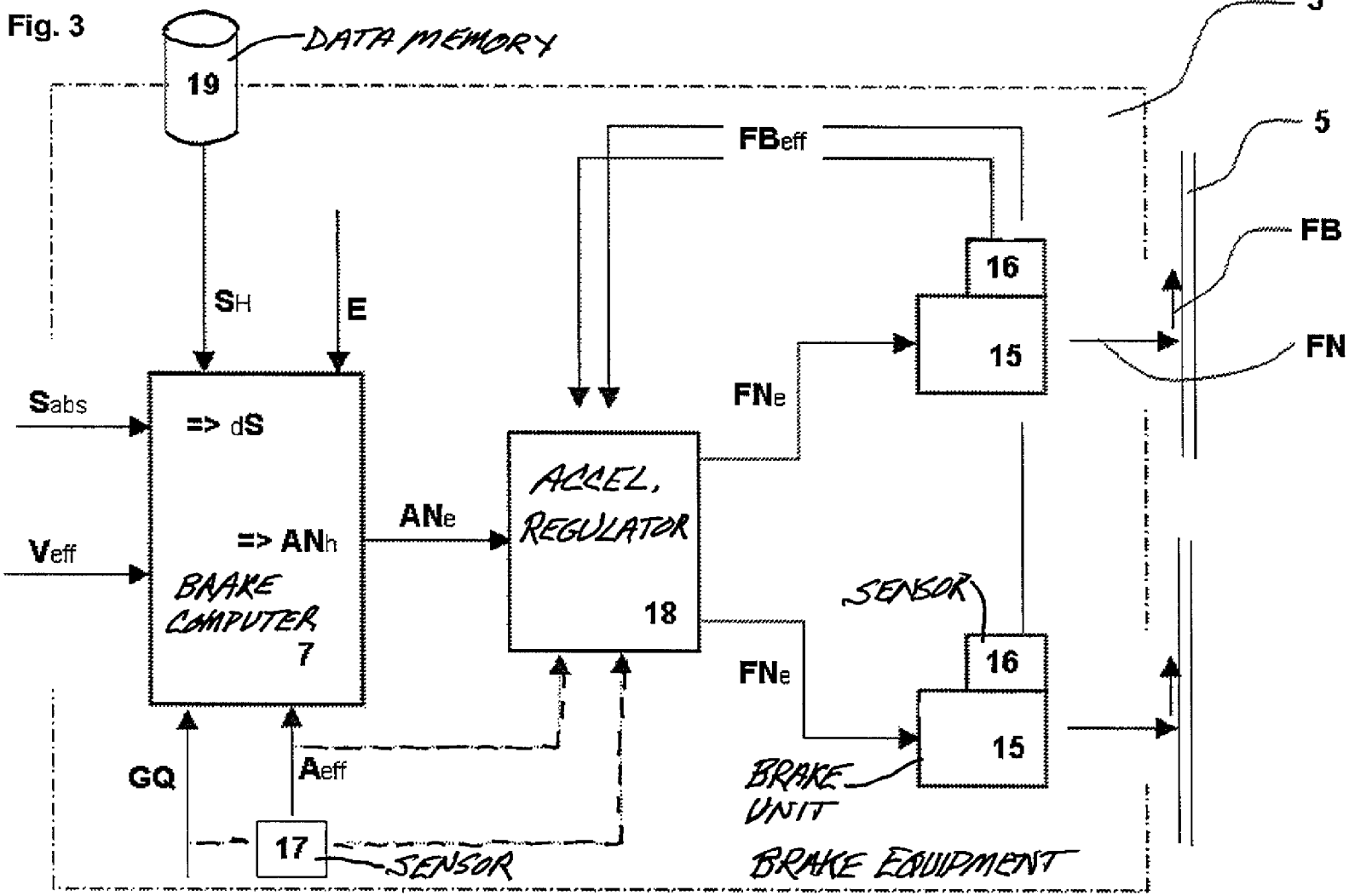
FIG. 3 shows a functional diagram of brake equipment.

The brake equipment 3, as it is used in the elevator system according to FIG. 1 and FIG. 1*a*, is explained by way of the functional diagram in FIG. 3. The brake computer 7 constantly computes, during the normal operating mode, a hypothetically required deceleration ANh which would be required if the elevator car in the case of an emergency should be brought rapidly to standstill. The brake computer 7 for this purpose knows an instantaneous position Sabs of the elevator car 2 and compares this instantaneous position Sabs with a data memory of the absolute positions 19, which contains the absolute positions values SH0 to SHn of the exit zones 8. The brake computer 7 determines therefrom a distance dS to the next exit region 8 and it ascertains, with consideration of a current speed Veff, the hypothetically required deceleration ANh. If the hypothetically required deceleration ANh should yield a value which is too high, a next exit region 8 is selected and accordingly a new hypothetically required deceleration ANh determined. This hypothetically required deceleration ANh can be a constant value or a defined deceleration course which, for example, starts with a low rate of deceleration and increases prior to reaching the exit region 8.

The determination of the instantaneous position Sabs of the elevator car 2 can be carried out in different mode and manner. Thus, an absolute position detection system can be used or the position Sabs of the elevator car 2 can also be calculated from the acceleration sensor 17. Equally, the current speed Veff can be measured by way of a speed sensor or use can be made of the above-mentioned sensor systems such as the absolute position detection system or the acceleration sensor 17 for the derivation.

If now an emergency situation or a fault event E occurs, the acceleration regulator 18 takes over the already-existing hypothetically required deceleration ANh as required deceleration ANe. The acceleration regulator 18 consequently determines a required braking force FB and normal forces FNe with consideration of the current load GQ, the current acceleration state Aeff and possible further parameters, and communicates these forces to the individual brake units 15, which now provide the required braking force FB or normal force FN. The effective braking force FBeff is measured by means of the braking force sensor 16 and communicated to the acceleration regulator 18 for checking and possible correction.

The acceleration regulator 18 can now establish when the effective direction of the braking force FB suddenly changes or when an abrupt change in the measured value of the braking force or in the actual acceleration Aeff takes place. Both events indicate that the elevator car 2 has reached the stopping point and the acceleration regulator 18 can increase the normal force default at the brake units to a safe value. This is important to the extent that as a consequence—since the elevator car comes to a standstill in the proximity region 11—a load change by persons, who can now leave the car 2, or by assist personnel, who enter the elevator car 2, can take place. This load change causes a shift of a force equilibrium. This could, without appropriate adjustment of the brake equipment, lead to slipping of the elevator car.

A division of the functional groups into brake computer 7 and acceleration computer 18 is obviously possible. More finely structured functional groups can be used or use can be made of integrated functional groups which combine appropriate functions.

The concept of the invention in the example of the elevator system according to FIG. 1 and FIG. 1*a* is explained by way of a travel diagram of FIG. 2 as well as the functional diagram of FIG. 3.

A travel plot of an elevator car 2 in the form of a speed/time diagram is illustrated in the lower region of FIG. 2 and an exemplifying associated acceleration/braking-force diagram is shown in the upper region of the figure. The elevator car 2 travels in correspondence with a target speed plot in the direction of a lowermost position 19, corresponding with the exit SH0. In that case it travels past exits SHn to SH2. The brake computer then constantly calculates the hypothetically required deceleration ANh which would be required in order to reach the next possible approach region 11 with respect to an exit region 8. In this connection, "constantly" embraces a calculation taking place at an evaluation frequency predetermined by a processor of the brake computer. In a transition region A where reaching of different exit positions SH is possible, decision criteria, which regulate a selection, are filed. Decision criteria of that kind can be the disposition of a relevant exit position, evacuation possibilities, the form of a registered event, etc.

In the illustrated travel plot, an event (E) now occurs shortly after passing through the storey or the exit SH2. This event (E) signals a behavior which departs from the normal travel plot and is detected by a safety system of the elevator system 1 and which requires stopping of the elevator car 2 due to emergency. The brake computer 7 defines the last-calculated hypothetically required deceleration ANh now as currently required deceleration ANe. The acceleration regulator 18 determines required normal forces FNe on the basis of this required deceleration ANe and current data such as instantaneous acceleration Aeff or load GQ and a characteristic of the associated brake units 15 and the brake units set this normal force FNe.

This produces—usually by friction—in co-operation with the brake track 5 a corresponding braking force FB. This now effectively acting braking force FBeff is detected by the braking force sensor 16 and communicated to the acceleration regulator 18. In a first phase of the braking the total braking force amounts to FBeff_1 and thus produces a corresponding deceleration ANe1. In correspondence with the predetermined course of the required deceleration ANe, in the example the braking force FB is increased in a second braking phase and the resulting braking force FBeff_2 produces a correspondingly higher final deceleration ANe2. As illustrated in the diagram in the upper diagram region, the braking force sensors 16 or the totality thereof now measure or measures a total braking force FBeff_2 as long as the elevator car is in motion. As soon as the car 2 comes to a stop, a component of deceleration disappears and the force FBeff_2 ascertained by the braking force sensor 16 is suddenly reduced by a value dFBeff. This change dFBeff is recognized by the acceleration regulator 18 and the default value FNe at the brake unit 15 is, if required, strongly increased so that now the elevator car 2 is securely fixed.

Depending on the actual load GQ and travel direction as well as the kind of event (E) the change in the value dFBeff can in many cases embrace a change in sign. This is the case when, without action of the brake equipment 3, a change of travel direction would result.

The illustrated example is one possibility for realization of the invention. With knowledge of the present invention the elevator expert can change the specified forms and arrangements as desired. Thus, by way of example, for secure fixing of the elevator car 2 after braking has taken place the acceleration regulator can also raise the target value of the deceleration to a high value ANe3. Since this value cannot be attained in view of the fact that the car 2 is already stationary, the clamping force FN is necessarily increased to a maximum. Moreover, the brake equipment 2 obviously also takes shaft ends 12 into consideration. If several elevator cars 2 travel in one shaft, one of the further cars can represent a virtual shaft end 12. The brake computer 7 considers these shaft ends 12, or a further elevator car, as position marks SH which under no circumstances should be passed and selects, in the case of approach to these position marks, a deceleration which if need be is correspondingly high.

In addition, instead of an elevator car carried by way of suspension means use can also be made of automotive elevator cars and the illustrated shaft can be an entirely or partly open shaft. Equally, the brake units employed can embrace different functional principles.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system with an elevator car and with brake equipment, the elevator car being movable in normal operation and in a special operating mode and being able to be decelerated to standstill and held at standstill by the brake equipment by a braking force produced by the brake equipment engaging with a brake track, wherein the brake equipment calculates a required deceleration in order to bring the elevator car to standstill within an exit zone in the special operating mode, comprising: the brake equipment during movement of the elevator car in the normal operating mode calculates a plurality of times a hypothetically required deceleration which would be required in order to bring the elevator car to standstill within the exit zone in the direction of travel using the special operating mode; and the brake equipment in response to an occurrence of an event uses a most recent one of the hypothetically required decelerations as the required deceleration for the braking in the special operating mode.

2. The elevator system according to claim 1 wherein the brake equipment with use of the required deceleration determines further brake regulating variables such as a required braking force or a normal force.

3. The elevator system according to claim 1 wherein the brake equipment determines at least one of a brake application point delayed in time when required for reaching the exit zone and the hypothetically required deceleration is a reference acceleration curve of any form suitable for reaching the exit zone.

4. The elevator system according to claim 1 wherein the required deceleration or a brake application point delayed in time is determined with consideration of at least one of: a current speed of the elevator car; a current position of the elevator car with respect to a shaft door, an emergency door, a shaft end, or a further elevator car; an operating mode of the elevator system; and a state of the brake equipment.

5. The elevator system according to claim 1 wherein the brake equipment includes an acceleration sensor for measuring an actual acceleration of the elevator car and an acceleration regulator which during braking uses the required deceleration as a target value and a normal force as a correcting variable.

6. The elevator system according to claim 1 wherein the brake equipment recognizes that a standstill of the elevator car has taken place when an abrupt change in a braking force or an abrupt change in a measured effective acceleration is detected.

7. The elevator system according to claim 6 wherein the brake equipment sets a normal force in correspondence with a holding force when it is detected that the standstill has taken place or the brake equipment sets the normal force after a maximum expected time of braking or to a value corresponding with the holding force when a brake fault is detected.

8. A brake equipment for an elevator car, which brake equipment can in a special operating mode decelerate the elevator car to standstill and hold it at standstill, wherein the brake equipment calculates a required deceleration in order to bring the elevator car to standstill within an exit zone in the special operating mode, comprising: the brake equipment during movement of the elevator car in a normal operating mode calculates a plurality of times a hypothetically required deceleration which would be required in order to bring the elevator car to standstill at a next exit zone in the special operating mode; and the brake equipment on the occurrence of an event uses a most recent one of the hypothetically required decelerations as the required deceleration for the braking in the special operating mode.

9. A method of stopping an elevator car in a special operating mode with brake equipment, the elevator car being moved in normal operation and in the special operating mode being decelerated to standstill and held at standstill by the brake equipment with a braking force produced by the brake equipment together with a brake track, wherein a required deceleration is calculated in order to bring the elevator car to standstill within an exit zone in the special operating mode, comprising the steps of:

during the movement of the elevator car in the normal operation a hypothetically required deceleration which would be required in order to bring the elevator car to standstill within the exit zone in the special operation mode is constantly calculated by the brake equipment; and on occurrence of an event the last calculated hypothetically required deceleration is used as the required deceleration for the braking in the special operating mode.

10. The method according to claim 9 recognizing that a standstill of the elevator car has taken place when an abrupt change in the braking force or a measured effective acceleration is detected.

* * * * *